United States Patent [19]

Yagi

[11] 4,165,807

[45] Aug. 28, 1979

[54] TAPE-MOUNTED ELECTRONIC COMPONENT PACKAGE

[75] Inventor: Hiroshi Yagi, Tokyo, Japan

[73] Assignee: Tokyo Denki Kagaku Kogyo Kabushiki Kaisha, Tokyo, Japan

[21] Appl. No.: 907,519

[22] Filed: May 19, 1978

[30] Foreign Application Priority Data

May 19, 1977 [JP] Japan ..... 52-64325[U]

[51] Int. Cl.[2] ..... B65D 5/72; B65D 85/671; B65H 5/28

[52] U.S. Cl. ..... 206/409; 206/331; 206/330

[58] Field of Search ..... 206/331, 328, 329, 330, 206/408, 409, 395, 396, 398, 389, 412

[56] References Cited

U.S. PATENT DOCUMENTS

| | | | |
|---|---|---|---|
| 2,954,117 | 9/1960 | Freeburg | 206/331 X |
| 3,231,082 | 1/1966 | Weiss | 206/330 X |
| 3,861,560 | 1/1975 | Entwistle et al. | 206/409 |
| 3,913,786 | 10/1975 | Kartasuk | 206/409 X |
| 3,958,768 | 5/1976 | Fairbanks | 206/409 X |
| 4,004,688 | 1/1977 | Braden | 206/331 X |
| 4,006,854 | 2/1977 | Gibson et al. | 206/409 X |

*Primary Examiner*—Davis T. Moorhead

*Attorney, Agent, or Firm*—Blum, Moscovitz, Friedman & Kaplan

[57] ABSTRACT

A package for storing and feeding electronic components having parallel leads mounted equidistantly by the leads on tape is provided. The tape is wound in a spiral and packaged in the box prepared from a box blank. The box has a removable side face which is removed from the box for forming an opening through which the tape and the electronic components mounted thereon can be fed either manually or automatically without opening the package itself. The removable side face has an elongated retainer flap for serving to hold the tape and the electronic components mounted thereon firmly in position within the box.

8 Claims, 11 Drawing Figures

TAPE-MOUNTED ELECTRONIC COMPONENT PACKAGE

BACKGROUND OF THE INVENTION

The present invention relates generally to a package for electronic components mounted on tape, and particularly to a package, assembleable from a box blank for storing and removing a spirally-wound tape of a predetermined length having parallel lead electronic components mounted therein. The electronic components are typically condensers or resistors having parallel lead wires and the electronic components are mounted on the tape by means of the wires.

With the recent development of automatic machines for production of electronic components, it has become possible to manufacture these electronic components in great numbers and at high speed and to mount them automatically on tape. Using the lead wires of the component as the mounting means, such electronic components may be held equidistantly on a paper strip using an adhesive tape as the mounting means.

In general, the strip or tape is spirally-wound on a winding frame or core and transported and stored in this spirally-wound state. It can then be fed to an automatic inserting machine to be used in preparing printed circuits with the electronic components being removed from the tape as required. The electronic components are cut one by one and inserted at the specified positions into printed circuits. The transport and storage of the spirally-wound tape has presented some problems due to the fact that in the normal mounting arrangement electronic components protrude from one or both edges of the tape making them susceptible to damage. Naturally, sections of spirally-wound tape carrying components can be packaged, but then it becomes necessary to open each individual package and remove the tape therefrom as the tape is to be delivered to an automatic inserting machine. The manual handling of the packages is expensive and introduces the possibility of mistakes due to human error. Consequently, a package from which the tape could be fed without opening same is eminently desirable. Such a package should also be designed to protect the tape from dust and accidental contact either manual or with moisture.

A recent proposal for fulfilling this purpose includes a package box for mounting the spiral of tape carrying electronic components onto the feeding assembly of an electronic component inserting machine, keeping the spiral contained in the package box. The tape spiral is rotatably mounted inside the package, and outwardly folding or cutting off a portion of one of the side surfaces of the package, the tape carrying the electronic components is pulled from the box to be fed into the inserting machine.

The spiral of tape carrying the electronic components should be as tightly retained as possible in the packaged box so as not to damage the electronic components by shaking the spiral of tape in the package during transport or storage. However, the upper side and peripheral side of the spiral of tape should not make contact with the retaining means to facilitate the smooth rotation of the spiral in the package when the tape is pulled from the box. In order to avoid shaking during transport and storage in this conventional package box, top support flaps were provided to extend in a certain width from each edge of the side faces towards the center of the package box to support the spiral of tape firmly.

In this conventional package when a part of a side face is folded outwardly and the spiral of tape carrying electronic components is fed from the box, the support flaps remain in contact with and retain the upper side of the spiral of tape. At times this prevents the smooth rotation of the tape or may damage the electronic components mounted on the tape. If the support flaps are small enough to keep the contact with the tape at a minimum, it is impossible to protect the spiral of tape from shaking which results in the possibility of damage to the electronic components mounted on the tape. Accordingly, it would be desirable to provide an improved package for protecting the spirally-wound tape during storage and transport, yet adapted to free the spiral for feeding the tape into an automatic inserting machine.

SUMMARY OF THE INVENTION

Generally speaking, in accordance with the invention an improved package box for storing a spirally-wound tape with electronic components mounted thereon and for removing the tape therefrom. The package is assembleable from a box blank and has a cover which can be removed for inserting a spirally-wound tape having electronic components mounted thereon. An axial core is mounted on the inside bottom of the package for rotatably mounting a winding core on which the spiral of tape is wound. A second axial core may be mounted in a corresponding position on the inside surface of the box cover so that both ends of the winding core may be precisely positioned. The package has a removable side face in the side thereof for forming an opening for unwinding the spiral of tape from the package. The removable side face has an elongated retainer flap extending across the spirally-wound electronic components for firmly holding the tape in position within the box during transport and storage thereof.

In a preferred embodiment the tape has punched holes therein at distances corresponding to the distances between the electronic components. The punched holes for receiving driving means for moving the tape along at a rate corresponding to that at which the machine to which the tape is being fed is operating and for receiving positioning means for positioning the tape at the predetermined position in the machine.

Accordingly, it is an object of the invention to provide an improved package which can be assembled from a box blank and from which a spirally-wound tape having electronic components mounted thereon can be unwound therefrom without opening the cover of said box.

Another object of the invention is to provide a package for holding a spirally-wound tape having electronic components mounted thereon firmly in the package for protecting the components from the accidental damage during transport and storage thereof, while allowing the spiral to be unwound from the package smoothly when the spiral of tape is to be fed from the box into an automatic inserting machine.

A further object of the invention is to provide a package and spirally-wound tape in the package, said spirally-wound tape having electric components mounted thereon, the spiral of tape containing a spacer tape to compensate for the thickness of the electronic components on said tape, thereby insuring that the spiral of tape is essentially cylindrical rather than frusto-conical in shape.

Still other objects and advantages of the invention will in part be obvious and will in part be apparent from the specification.

The invention accordingly comprises an article of manufacture possessing the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
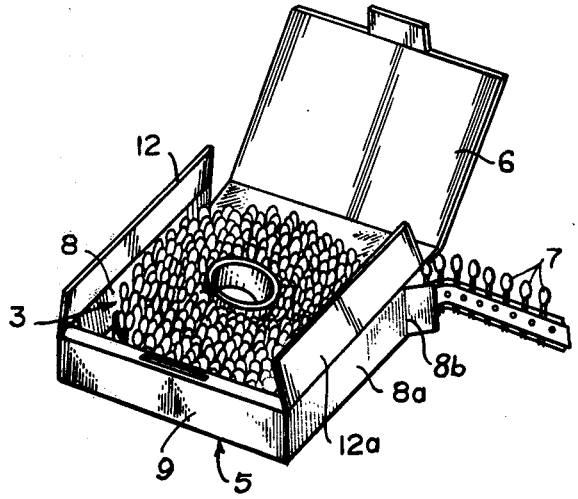
FIG. 1 is a perspective view of a package of the prior art including a spirally-wound tape having condensers mounted thereon.

Referring now to FIG. 1, a conventional package box for storing and feeding a spirally-wound support tape having a plurality of electronic components 7 mounted by lead wires disposed transversely thereon shown generally as 3 is depicted. The package includes a substantially square bottom section 5, a back face 11 and a front face 9 at two opposed edges of bottom section 5, a pair of opposed side faces 8 and **8*a* having a pair of top support flaps 12 and 12*a*, respectively, extending in towards the center of the package from each edge of side faces 8 and 8*a*. Support flaps 12 and 12*a* extend towards the center of the package for supporting the spirally-wound tape and electronic components 7** mounted thereon.

In this conventional package box, a portion of side face **8*a* is folded outwardly along a score line 8*b* for unwinding a spirally-wound support tape 3 having electronic components mounted thereon. A shortcoming occurs in utilizing this package box because support flaps 12 and 12*a* remain in contact with the upper portions of electronic components 7 thereby preventing the smooth rotational motion of spirally-wound tape 3 which may result in damage to electronic components 7 during unwinding. If support flaps 12 and 12*a* are formed small enough to keep contact with electronic components 7 at a minimum, the protection afforded to electronic components 7 during storage is reduced thereby resulting in the possibility of damage to electronic component 7**. This possibility of damage during storage and transport is overcome in accordance with the invention as described herein.

Figure 2:
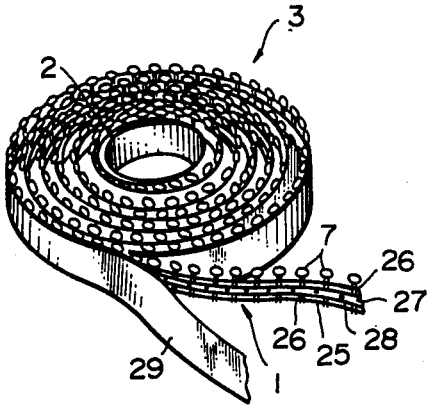
FIG. 2 is a perspective view of a spirally-wound tape in accordance with the present invention having electronic components mounted thereon and including a spacer tape for shaping said spiral.

Referring now to FIG. 2, a predetermined length of tape 25 having a plurality of electronic components 7 mounted thereon is shown generally as 1 wound around a cylindrical winding core 2. Electronic components 7 each having a set of parallel lead wires 26 are spaced equidistantly and held to support tape 25 and by adhesive tape 27. Support tape 25 with electronic components 7 mounted thereon is wound in a spiral indicated generally as 3 around winding core 2. "Spiral 3" hereinafter refers spirally-wound support tape 25 having a number of electronic components 7 mounted thereon with adhesive tape 27. A plurality of punched holes 28 are formed through adhesive tape 27, and if desired, through the support tape 25, can be used for positioning and drawing tape 25 incrementally, using a positioning means and a sprocket device of known form.

As support tape 25 is wound into spiral 3 in preparation for insertion into the package, the thickness of the components 7 may distort the winding, changing the form of the spiral 3 from the desired near-cylindrical form to an essentially frusto-conical form. To prevent this a spacer tape 29 of appropriate thickness is wound with the support tape 25 to compensate for the thickness of components 7, thereby keeping support tape 25 essentially parallel to the axis of spiral 3 and winding core 2.

Support tape 25 is of a relatively flexible material such as paper tape and the back surface thereof is flat except for those portions where feeding and positioning holes 28 are formed, thereby providing for winding tape 25 on winding core 2 easily and regularly. The width of adhesive tape 27 should be somewhat less than that of support tape 25 thereby making it possible to measure the properties of electronic components 7 by means of exposed portions of leads 26. Leads 26 generally are in sets of two but may be in sets of three for transistors or various other electronic components. Openings 28 are formed in tapes 25 and 27 at precisely equidistant spacings and generally along the transversely mid-portion of the tape 25.

Figure 3:
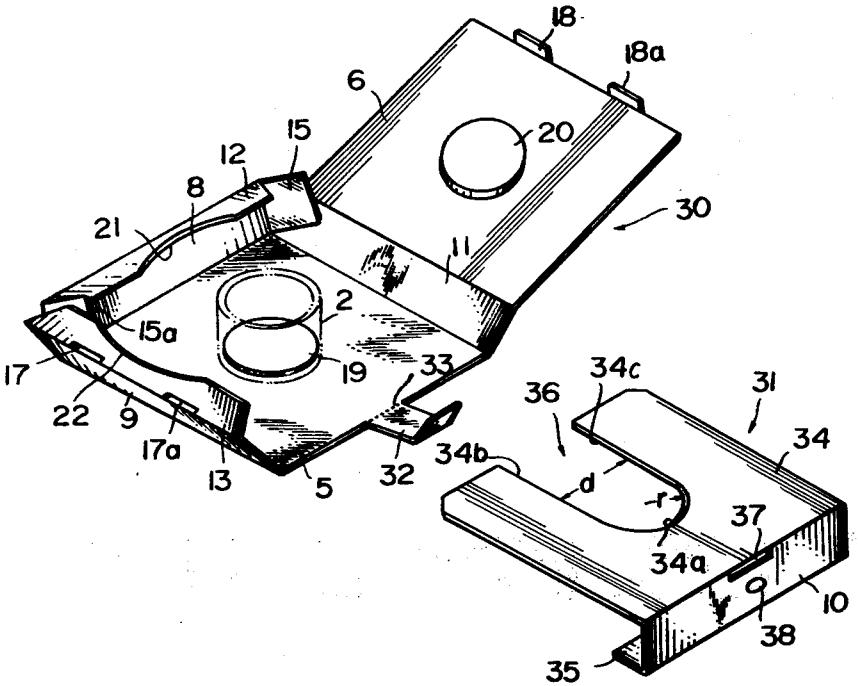
FIG. 3 is a perspective view of a box blank constructed and arranged in accordance with the invention for forming the package of FIG. 4.

Referring now to FIG. 3, a box blank assembleable in a package in accordance with the present invention is shown. The box blank includes a body member indicated generally as 30 and a removable side face retainer member indicated generally as 31. Box member 30 includes a substantially square bottom section 5 having a front fact 9, a back face 11 and a side face 8. Bottom section 5 is also a tongue 32 extending sidewise from the edge thereof opposite side face 8. A fold line 33 between bottom section 5 and tongue 32 is preferably provided with dash cuts for removing tongue 32 easily from body member 30. Front face 9 is joined to a top support flap 13. Similarly, side face 8 is joined to a top support flap 12. In the same manner, back face 11 is joined to a cover section 6 joined to two tongues 18 and 18*a*. As shown in FIG. 3, a pair of end flaps 15 and 15*a* are joined to each end of side face 8. Top support flap 13 on front face 9 has a pair of slots 17 and 17*a* therein for receiving tongues 18 and 18*a* on cover section 6 for holding cover section 6 in a closed position when the box blank is assembled. The edge of each top support flap 12 and 13 is shaped into a large arc 21 and 22 and should be terminated for certain clearance with the outer peripheral surface of spiral 3 to be packaged so that spiral 3 can be unwound from the assembled package box without contacting edges 21 and 22.

A disc-like axial core 19 is mounted on bottom section 5 of body member 30. While axial core 18 is sufficient for holding winding core 2 of spiral 3, a similar axial core 20, as shown in FIG. 3, may be placed on a corresponding portion of the inside face of cover section 6 for holding the upper end of winding core 2. The diameter of axial cores 19 and 20 should be somewht smaller than the inner diameter of winding core 2. Axial cores 19 and 20 can be of paper, or plastic or any other convenient material. Where the package is of plastic, axial cores 19 and 20 can be integrally molded as part of the blank.

Figure 4:
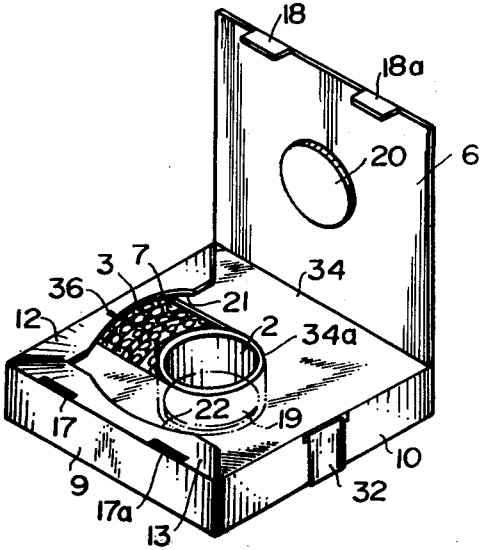
FIG. 4 is a perspective view of a package fromed from the box blank of FIG. 3 in accordance with the present invention including a spirally-wound tape having condensers mounted thereon.

Turning now to removable side face retainer member 31, as shown in FIG. 3, member 31 includes a face 10, a retainer flap 34 extending therefrom and a marginal flap 35 opposite thereto. Face 10 becomes one of the side faces of the box opposite side face 8, as shown in FIG. 4. When the box blank is assembled, retainer flap 34 is folded over onto spiral 3 (FIG. 4) for protecting the electronic components from damage during shipping and storage thereof. Marginal flap 35 of face 10 fits against the inside of bottom section 5 when the box blank is assembled. Face 10 has a slot 37 therein for receiving tongue 32 on bottom section 5 for holding face 10 in a closed position when the box blank is assembled. Slot 37, of course, may be arranged at the edge of retainer flap 34 adjacent to face 10, instead of being disposed on face 10.

As shown in FIG. 3, retainer flap 34 is formed with a notch 36 which consists of an arc portion 34*a* having a radius r larger than that of winding core 2. Notch 36 has an opening portion formed by two opposed cut edges 34*b* and 34*c* for defining a distance d between cut edges 34*b* and 34*c* larger than the diameter of winding core 2, so that the retainer flap 34 and face 10 can be removed from the assembled box without lifting cover section 6 of the box. Cut edges 34*b* and 34*c* are opposed in parallel in this embodiment, however, distance d between the cut edges 34*b* and 34*c* may become gradually larger toward the open end of notch 36. Face 10 is also formed with a hole 38 for pulling and removing removable member 31 from the assembled box with a finger. In each case, score lines are disposed between the sections of the box blank to facilitate folding the various sections, flaps, etc., inwardly for assembly of the package box as shown in FIG. 4.

Referring now to FIG. 4, a packaged box, assembleable from the box blank of FIG. 3, constructed and arranged in accordance with the invention with cover section 6 lifted is shown. Cylindrical winding core 2 with spiral 3 wound therearound is rotatably mounted on axial core 19. Cover section 6 folds over onto the retainer flap 34 for closing the package and tongues 18 and 18*a* on cover section 6 are inserted into slots 17 and 17*a* on top support flap 13. Thus, the upper side of spiral 3 can be held firmly by retainer flap 34 and cover section 6 so that shaking of spiral 3 in the box in the axial direction can be prevented during transport and storage thereof, thereby protecting electronic components 7 from accidental damage. Cylindrical winding core 2 of spiral 3 is held by axial cores 19 and 20 as well as the arc portion 34*a* of retainer flap 34 so that rolling of spiral 3 in the box is also prevented.

Figure 5:
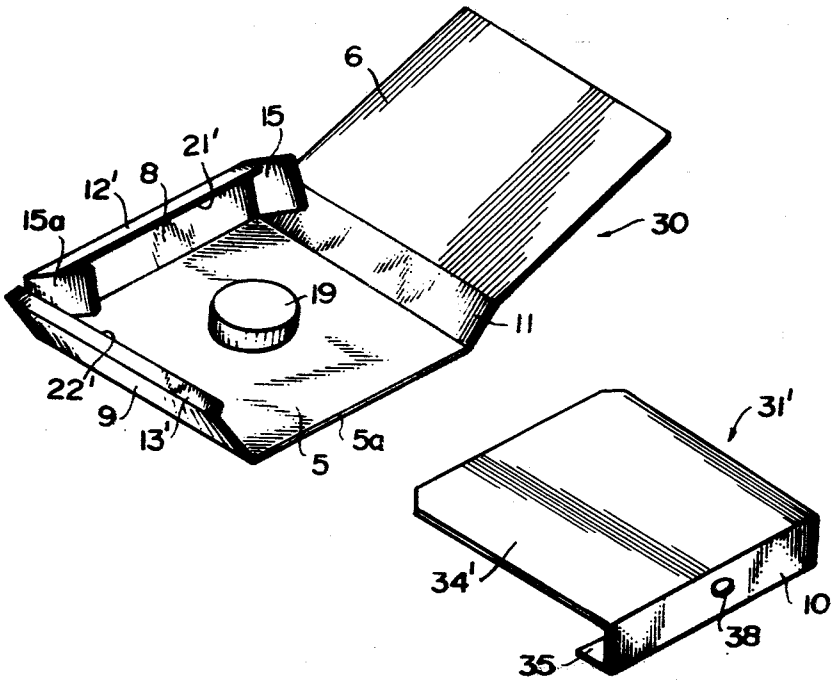
FIG. 5 is a perspective view of another embodiment of a box blank from which the package of FIG. 6 can be assembled.

Referring now to FIG. 5, another embodiment of a box blank assembleable into a package in accordance with the present invention is shown. In FIG. 5, the reference numerals used in FIG. 3 identify the same members as in the embodiment of FIG. 3, and a detailed description will be omitted here.

As shown in FIG. 5, disc-like axial core 2 is mounted only to bottom section 5. A disc-like axial core 19' is, as can be seen, relatively thick in an axial direction thereof in comparison with that of disc-like axial core 19 of the box blank in the embodiment of FIG. 3. Accordingly, axial core 19' will suffice to hold winding core 2 with spiral 3 wound therearound, even if axial core 20 on cover section 6 as in the embodiment of FIG. 3 is not provided.

As cover section 6 is not provided with an axial core, a retainer flap 34' of removable member 31' is flat and is not provided with a notch as notch 36 in the embodiment of FIG. 3. Retainer flap 34', therefore, serves to hold all of the upper side of spiral 3 to be packaged in the box. Each edge 21' and 22' of top support flaps 12 and 13 is shaped straight.

Figure 6:
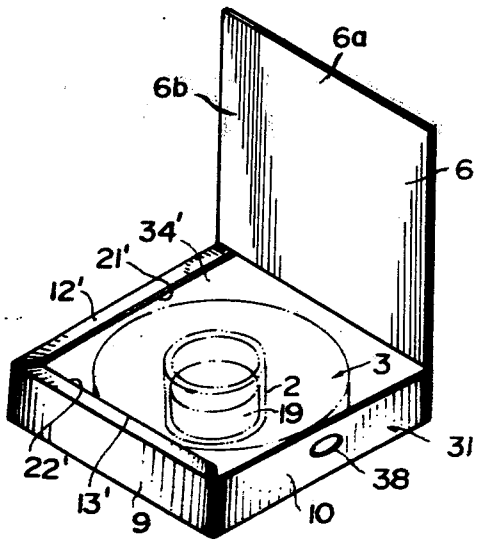
FIG. 6 is a perspective view of another embodiment of a package in accordance with the present invention.

In assembling the packaged box from the box blank of FIG. 5, winding core 2 and spiral 3 wound therearound are mounted on disc-like axial core 19' on the bottom section 5. End flaps 15 and 15*a* fit against the inside of back face 11 and front face 9, respectively, and can be glued thereto if desired. Marginal flap 35 of removable member 31' fits against an edge portion 5*a* of bottom section 5 and may be glued thereto by adhesive, if desired a retainer flap 34' is folded over onto the spiral 3. Top support flaps 12' and 13' of side face 8 and front face 9, respectively, are folded over onto retainer flap 34' for obtaining a packaged box as shown in FIG. 6 wherein the upper side of spiral 3 is covered and held in position by retainer flap 34'. Top support flap 13 is boned to an edge portion 6*a* of cover section 6 by adhesive. Top support flap 12 may be bonded to an edge portion 6*b* of cover section 6 by adhesive, if desired.

When it is desired to unwind from the packages prepared in the above-mentioned embodiments, removable member 31, including retainer flap 34 is first removed from body member 30 by pulling it with a finger leaving cover section 6 closed. After removing retainer flap 34, spacing is provided between upper side of spiral 3 and the inner surface of cover section 6. Support flaps 12 and 13 having been so arranged that edges 21 and 22 do not maintain contact with the peripheral surface of spiral 3. Accordingly, spiral 3 may be smoothly rotated in the package.

Figure 8:
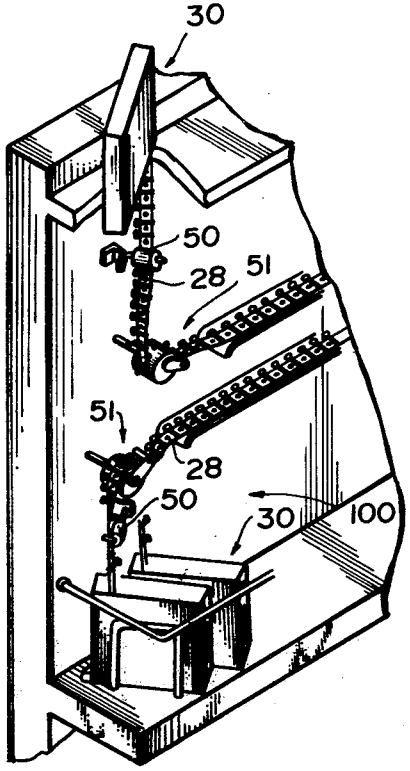
FIG. 8 is a perspective view of package boxes constructed in accordance with the invention mounted on a feeding assembly of an automatic inserting machine.
Figure 7:
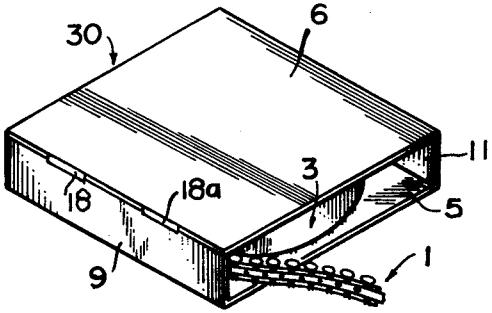
FIG. 7 is a perspective view of a package with a removable side face is removed, showing tape with components mounted thereon being fed from said package through the side opening.

The tape carrying electronic components indicated generally by the reference numeral 1 is pulled from the prepared package as shown in FIG. 7. The package box assembled from body member 30 having spiral 3 therein is then mounted in a predetermined position in a feeding assembly 100 of an automatic inserting machine (not shown), and the removed tape is led through a roller 50 to a sprocket assembly 51, where holes 28 of tape 1 are engaged with sprockets on sprocket assembly 51, as shown in FIG. 8. In operation, tape 25 having electronic components 7 mounted thereon can be fed from the package box smoothly, due to the fact that spiral-wound tape 3 can smoothly rotate in the box without any interference.

Figure 9:
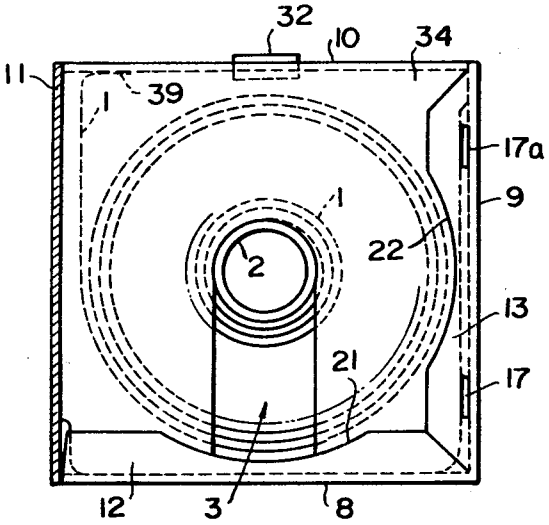
FIG. 9 is a plan view of a package constructed in accordance with the invention for mounting the spirally-wound tape with the cover section omitted for clarity.

Turning now to FIG. 9, a plan view of the package box shown in FIG. 4 before removing the removable member 31, with cover section 6 omitted for clarity, is shown. A part of the end portion of retainer flap 34 overlaps with top support flaps 12 and 13 resulting in layered regions. The end portion 39 of tape carrying electronic components 7 is fixed to the inside surface of face 10 with, for example an adhesive, adhesive tape or metal fittings (not shown). By this arrangement, end portion 39 of tape 1 can be pulled simultaneously with the removal of removable member 31 from the box, thereby facilitating the unwinding of tape 1. The end portion of spacer tape 29 may be attached to the inside surface of face 10 in this manner to assist in unwinding tape 1. End portion 29 of tape 1 and spacer tape 29, of course, may be fixed to retainer flap 34, or marginal flap 35, if desired.

Figure 10:
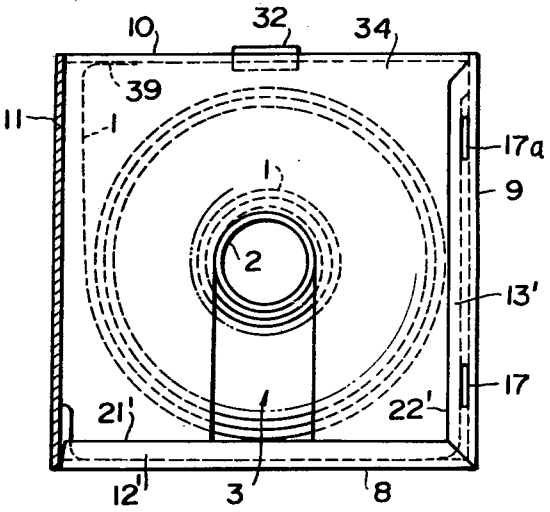
FIG. 10 is a plan view of a package constructed in accordance with another embodiment of the invention for mounting the spirally-wound tape with the cover section removed for clarity.

FIG. 10 is another embodiment in accordance with the present invention, in which edges 21' and 22' of top support flaps 12' and 13' are straight lines. As top support flaps 12' and 13' are not needed to retain the upper side of spiral 3 as in the package box of the first embodiment, they may have a minimum width so long as they provide sufficient strength to the assembled box itself. When edges 21' and 22' are straight lines as in the second embodiment of FIG. 5, molding and maintenance of the puncher apparatus for making the blank are simplified.

Figure 11:
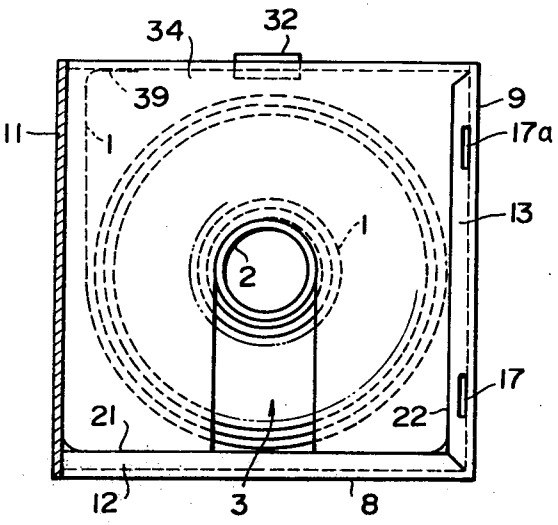
FIG. 11 is a plan view of a package constructed in accordance with a further embodiment of the invention for mounting the spirally-wound tape with the cover section removed for clarity.

FIG. 11 illustrates a further embodiment of the present invention, in which the edge portions of retainer flap 34 do not overlap with edges 21' and 22' of top support flaps 12 and 13, respectively, but borders on edges 21' and 22'. Therefore, unnecessary clearance which will be produced by overlapping is eliminated permitted a firmer package.

It is evident from the foregoing illustrations that a package box constructed and arranged in accordance with the present invention provided with a retainer flap for inserting into the space between the upper side of the spiral of tape carrying electronic components and the inside of the cover section of package box results in an improved package box. The retainer flap is formed integrally with the removable side face to permit removal from the assembled box together with the side face. As a result of providing this type of package, the spiral of tape is effectively prevented from shaking in the package during transport and storage, thereby preventing the electronic components from accidental damage. Furthermore, when the tape carrying electronic components is to be fed into the inserting machine for inserting the components into printed circuit board, the spiral can rotate smoothly in the box without any interference, thereby allowing the electronic components mounted on the tape to feed smoothly into the machine.

It will thus be seen that the objects set forth above, among those made apparent from the preceding description, are efficiently attaind and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A package box, assembleable from a box blank for storing and feeding a spirally-wound support tape having parallel lead electronic components mounted on the support tape by the lead wires disposed transversely across the support tape, comprising:

a body member; and a separate removable member;

said body member and said removable member cooperating to form a box when assembled, said separate member being removable from said box to permit unwinding of the spirally-wound support tape from the box;

said body member including a substantially square bottom section, a back face and a front face at two opposed edges of said bottom section, said back and front faces each having two edges, a side face at one of the remaining edges of said bottom section, said side face having two ends and two edges, an end flap at each end of said side face, a score line between each of said end flaps and said side face, a cover section of substantially the same size and shape as said bottom section at an edge of said back fence, a score line between said cover section and said back face, a first top support flap at an edge of said front face, a score line between said front face and said first top support flap, a second top support flap at an edge of said side face, a score line between said side face and said second top support flap, all of said score lines positioned for folding said faces and flaps in an inward direction during assembly of said box, and an axial core on said bottom section for rotatably mounting said spirally-wound support tape; and said removable member including a face of substantially the same size and shape as said side face for forming one of the side faces of the box, said face of said removable member having two ends and two edges, a retainer flap at an edge of said face of said removable member for holding said spirally-wound support tape in said box, a score line between said face and said retainer flap, a marginal flap at the remaining edge of said face for overlapping the remaining edge of said bottom section, a score line between said face and said marginal flap, said score lines on said removable member positioned for folding said retaining flap and said marginal flap in an inward direction during assembly of said box.

2. The box blank of claim 1, further comprising a support tape, electronic components having sets of parallel leads, and an adhesive tape holding said sets of parallel leads spaced apart equidistantly against said tape whereby said electronic components are at uniform spacing, said tape being spirally wound on said winding core rotatably mounted on said axial core.

3. The box blank of claim 2, further comprising a spacer tape spirally wound with said tape and said components, the thickness of said spacer tape being such as to compensate for the thickness of said components for maintaining said spirally wound tape in being an essentially cylindrical form rather than a frusto-conical form.

4. The box blank of claim 2, wherein said tape has punched openings therethrough at regular intervals corresponding to the distance between sets of parallel leads of said electronic components for transporting and positioning said tape.

5. The box blank of claim 2, wherein the outer end of said spirally wound support tape is fixed to the inside surface of said face on said removable member.

6. The box blank of claim 2, wherein the outer end of said spacer tape is fixed to the inside surface of said face on said removable member.

7. The box blank of claim 2, wherein each said edge of said first and second top support flaps of said side and front face is a straight line.

8. The box blank of claim 2, wherein each said edge of said first and second top support flaps of said side and front faces borders on the corresponding edges of said retainer flap so as not to overlap with said retainer flap when said box blank is assembled into a box.

* * * * *